US007931159B2

(12) United States Patent
Kao

(10) Patent No.: US 7,931,159 B2
(45) Date of Patent: Apr. 26, 2011

(54) SUSPENSION DISPLAY RACK

(76) Inventor: Jui-Chien Kao, Tali (TW)

( * ) Notice: Subject to any disclaimer, the term of this patent is extended or adjusted under 35 U.S.C. 154(b) by 0 days.

(21) Appl. No.: 12/423,684

(22) Filed: Apr. 14, 2009

(65) Prior Publication Data

US 2009/0194494 A1 Aug. 6, 2009

Related U.S. Application Data

(62) Division of application No. 11/505,471, filed on Aug. 17, 2006, now abandoned.

(51) Int. Cl.
*A47F 7/00* (2006.01)

(52) U.S. Cl. ..... 211/70.6; 211/94.01

(58) Field of Classification Search ..... 211/70.6, 211/69, 113, 94.01, 87.01; 248/224.8, 220.21, 248/220.31, 298.1, 220.22; 206/378, 349, 206/341

See application file for complete search history.

(56) References Cited

U.S. PATENT DOCUMENTS

| | | | | | |
|---|---|---|---|---|---|
| 3,154,281 | A | * | 10/1964 | Charles | 248/201 |
| 3,342,344 | A | * | 9/1967 | Magnuson | 211/113 |
| 3,980,384 | A | * | 9/1976 | Lawson | 439/710 |
| 4,209,098 | A | * | 6/1980 | Adams | 211/70.8 |
| D257,950 | S | * | 1/1981 | Van Meter et al. | D8/396 |
| 4,781,608 | A | * | 11/1988 | Hillmann | 439/212 |
| 5,188,325 | A | * | 2/1993 | Hilty et al. | 248/224.8 |
| 5,419,443 | A | * | 5/1995 | Niederberger et al. | 211/70.6 |
| 5,715,951 | A | * | 2/1998 | Dembicks | 211/70.6 |
| 5,727,697 | A | * | 3/1998 | Ricciardelli et al. | 211/89.01 |
| 5,897,002 | A | * | 4/1999 | Carlino | 211/70.6 |
| 6,092,655 | A | * | 7/2000 | Ernst | 206/378 |
| 6,386,363 | B1 | * | 5/2002 | Huang | 206/378 |
| 6,494,329 | B1 | * | 12/2002 | Dembicks | 211/70.6 |

* cited by examiner

*Primary Examiner* — Darnell M Jayne
*Assistant Examiner* — Stanton L Krycinski
(74) *Attorney, Agent, or Firm* — Hershkovitz & Associates, LLC; Abraham Hershkovitz

(57) ABSTRACT

A suspension display rack has a board, a rail, and multiple brackets. The board has a back-strip. The back strip has two first positioning holes. The rail is mounted on a front surface of the board and has an upper lug and a lower lug formed respectively on a top and a bottom of the rail. The brackets are mounted on the rail and each bracket has a bar engaging with the board, a holder (21) and a seat. When the board is mounted securely on a wall or a tool car, tools can connect to the seats of the brackets for positioning.

5 Claims, 14 Drawing Sheets

SUSPENSION DISPLAY RACK

The present application is a divisional application of application Ser. No. 11/505,471, filed on Aug. 17, 2006 now abandoned, the disclosure of which is expressly incorporated by reference herein in its entirety.

BACKGROUND OF THE INVENTION

1. Field of the Invention

The present invention relates to a suspension display rack, and more particularly to a suspension display rack with easy assembly and that can position tool stably.

2. Description of the Related Art

A conventional suspension display rack is used to suspend screwdrivers, wrenches and etc. The conventional suspension display rack has a hanging board. Multiple holes are defined in the hanging board and multiple supporting members are mounted respectively in the hanging board.

However, screws are inserted respectively into the holes to position the conventional suspension display rack at a desired place. The supporting members are formed integrally or engage with the hanging board thereby generating a low coherent strength.

Therefore, the invention provides a suspension display rack to mitigate or obviate the aforementioned problems.

SUMMARY OF THE INVENTION

The main objective of the present invention is to provide a suspension display rack, and more particularly to a suspension display rack with easy assembly and stable structure which can position tool stably.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1-4, a first preferred embodiment of a suspension display rack in accordance with the present invention has a board (10A) and multiple brackets (20A) connecting to the board (10A).

The board (10A) has a transverse back-strip (11A) and a rail (12A). The back strip (11A) has two first positioning holes (111A) and a rib (112A). The first positioning holes (111A) are non-circular and are respectively defined through the back strip (11A) near two ends of the back strip (11A). The rib (112A) is formed transversely on a front surface of the back strip (11A) and has multiple circular jointing holes (113A) respectively defined in the rib (112A) and corresponding to the brackets (20A).

The rail (12A) is mounted securely on the back strip (11A), is longer than the rib (112A) and has a rear surface, two sides, a C-shaped channel (121A), two second positioning holes (122A), multiple circular holes (123A), an upper lug (124A) and a lower lug (125A). The channel (121A) is defined in the rear surface of the rail (12A) and corresponds to and is mounted around the rib (112A). The second positioning holes (122A) are formed through the rail (12A) and respectively correspond to the first poisoning holes (111A). The circular holes (123A) are formed through the rail (12A) and respectively correspond to the jointing holes (113A). The upper lug (124A) and the lower lug (125A) are formed respectively on the two sides of the rail (12A).

Each bracket (20A) has a holder (21A), a bar (22A) and a seat (23A).

The holder (21A) is U-shaped, is held on the rail (12A) and has an upper arm (211A) abutting the upper lug (124A) and a lower arm (212A) abutting the lower lug (125A) to hold the holder (21A) on the rail (12A).

The bar (22A) is circular in cross section, extends into one of the circular holes (123A) in the rail (12A), is formed transversely on a rear end of the holder (21A) and is inserted into one of the jointing holes (113A). The bar (22A) has a threaded hole (221A) defined in a free end of the bar (22A). Multiple bolts (222A) respectively extend through the jointing holes (113A) and are screwed respectively into the threaded holes (221A) in the bars (22A) to mount the bracket (20A) securely on the rail (12A).

The seat (23A) is formed on a front end of the holder (21A) and has a supporting member. In the first preferred embodiment of the present invention, the supporting member is a through hole (231A) defined through two sides of the seat (23A).

Figure 1:
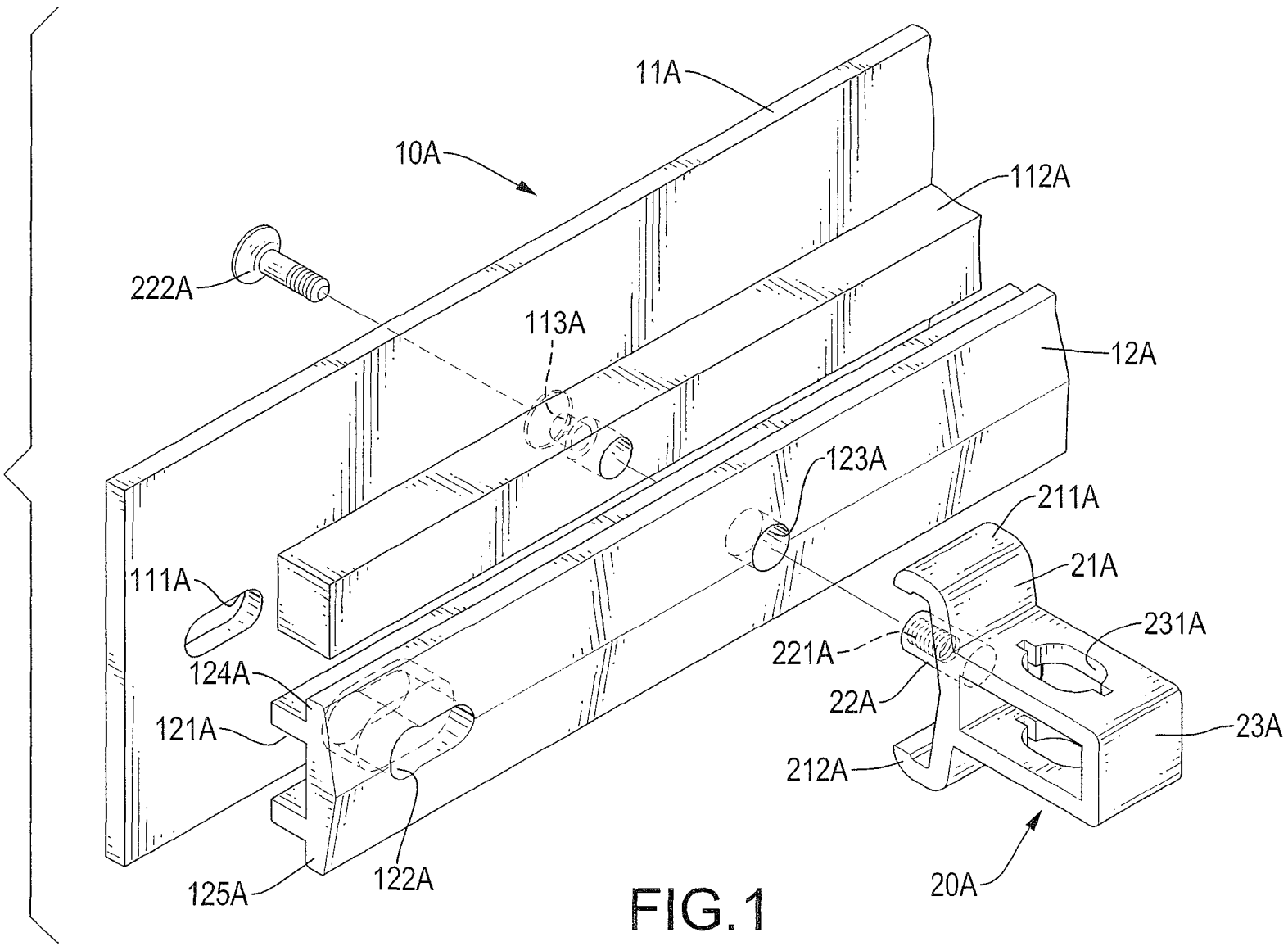
FIG. 1 is an exploded perspective view of a first preferred embodiment of a suspension display rack in accordance with the present invention.
Figure 2:
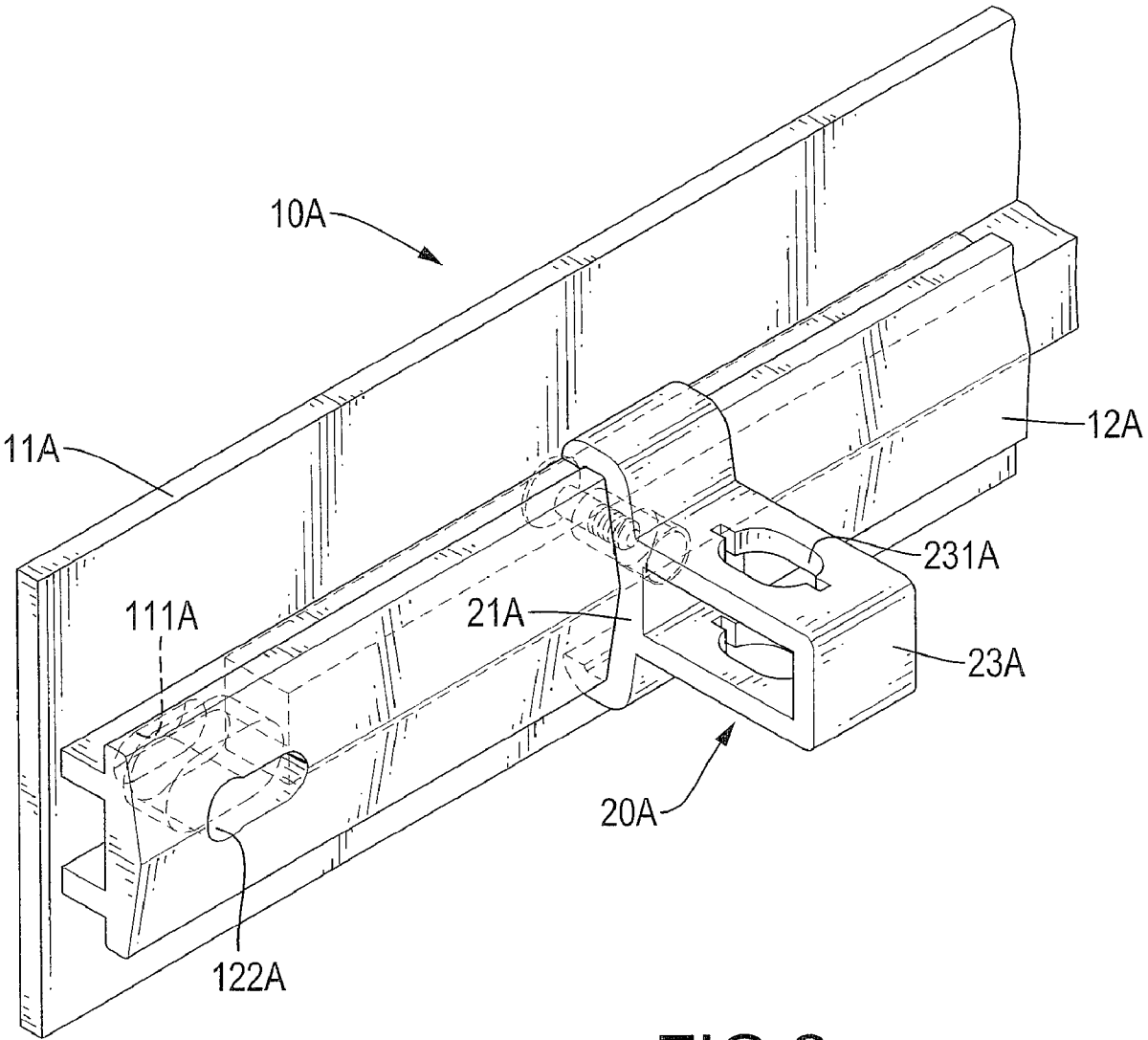
FIG. 2 is a perspective view of the first preferred embodiment of the suspension display rack in FIG. 1.
Figure 3:
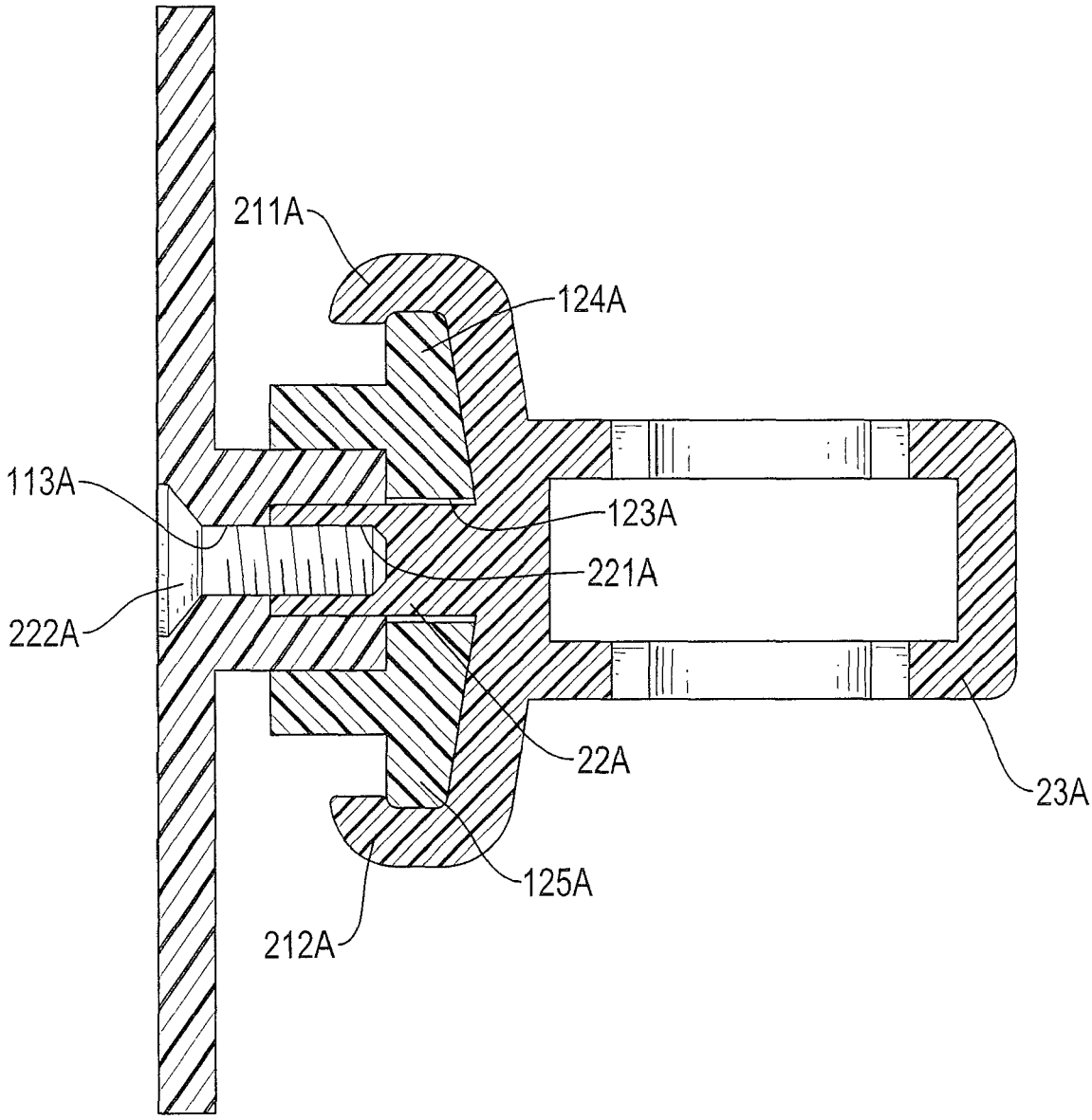
FIG. 3 is a side view in partial section of the first preferred embodiment of the suspension display rack in FIG. 1.
Figure 4:
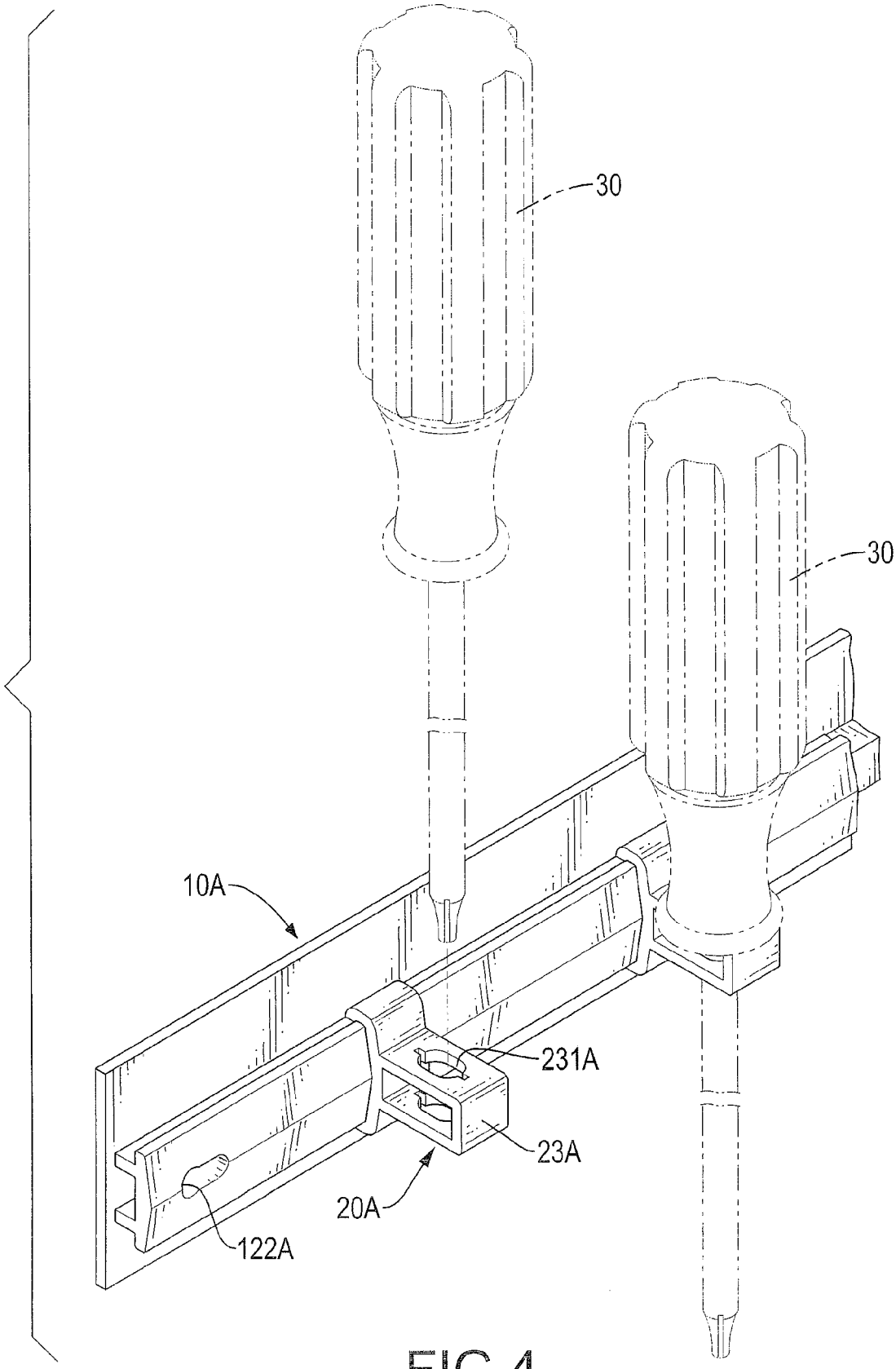
FIG. 4 is an operational exploded perspective view of the first preferred embodiment of the suspension display rack in FIG. 1 in usage.
Figure 5:
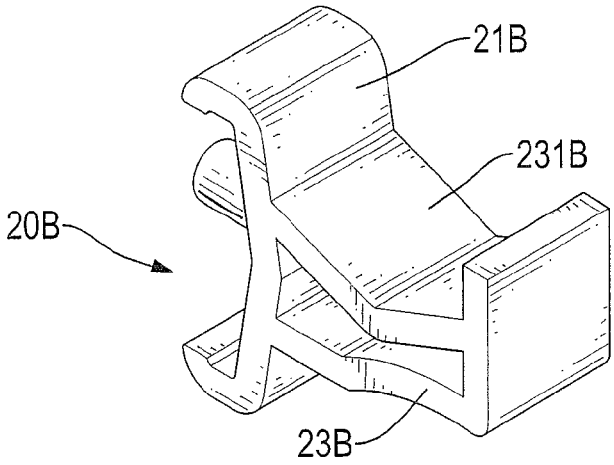
FIG. 5 is a perspective view of a second preferred embodiment of a bracket of a suspension display rack in accordance with the present invention.
Figure 8:
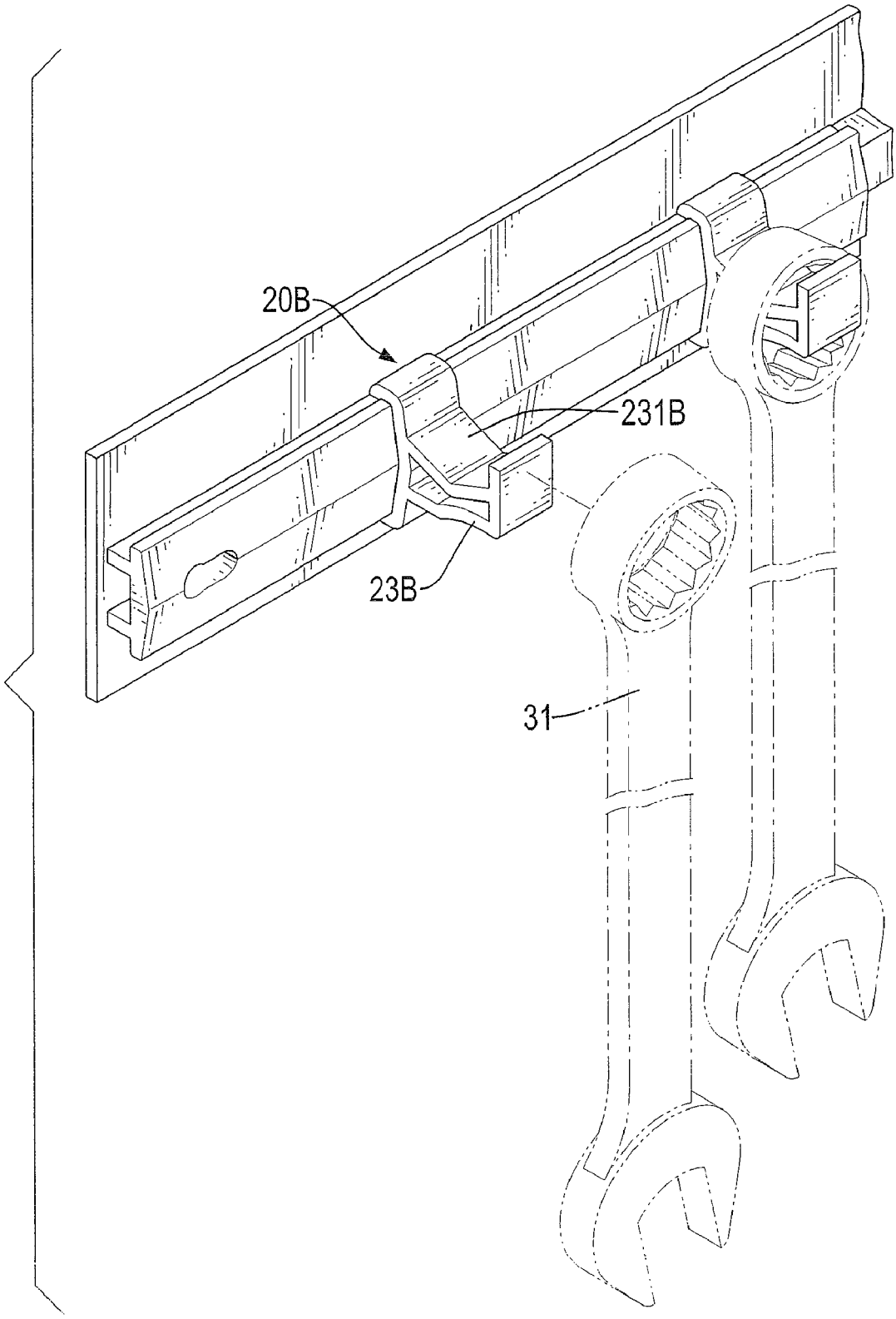
FIG. 8 is an operational exploded perspective view of the second preferred embodiment of the suspension display rack in FIG. 5 in usage.

In assembly, multiple bolts are respectively inserted into the first and second positioning holes (111A, 122A) so that the board (10A) is securely mounted on a wall or a tool car. With reference to FIG. 4, screwdrivers (30) can be inserted into the through hole (231A) in the seat (23A) for positioning. With reference to FIGS. 5 and 8, a second preferred embodiment of a suspension display rack in accordance with the present invention is similar to the first preferred embodiment except that each seat (23B) of the bracket (20B) has a recess (231B). The recess (231B) is defined in the seat (23B). Spanners (31) can be suspended in the recess (231B) of the seats (23B).

Figure 6:
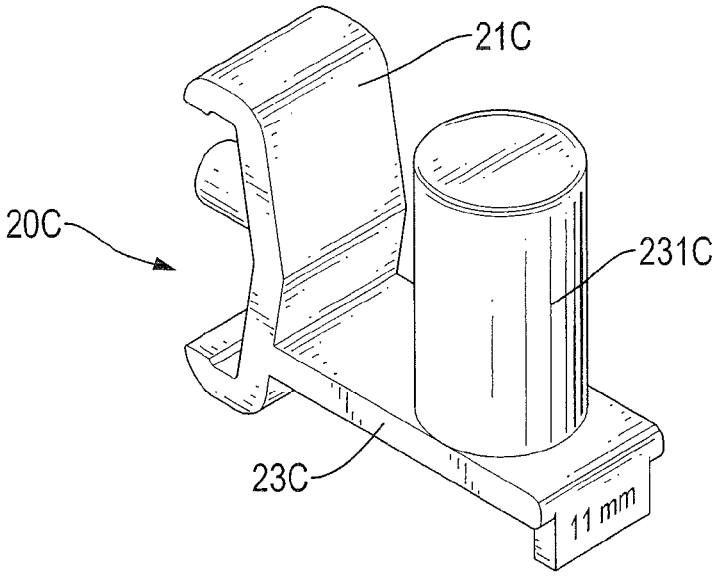
FIG. 6 is a perspective view of a third preferred embodiment of a bracket of a suspension display rack in accordance with the present invention.

With referenced to FIG. 6, a third preferred embodiment of a suspension display rack in accordance with the present invention is similar to the first preferred embodiment except that each seat (23C) of the bracket (20C) is flat and has a cylinder. The cylinder (231C) is formed uprightly on the seat (23C).

Figure 7:
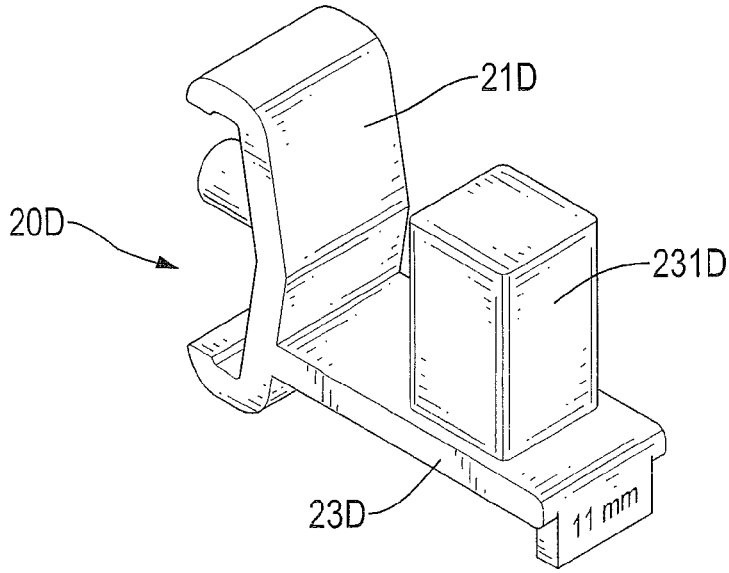
FIG. 7 is a perspective view of a fourth preferred embodiment of a bracket of a suspension display rack in accordance with the present invention.
Figure 9:
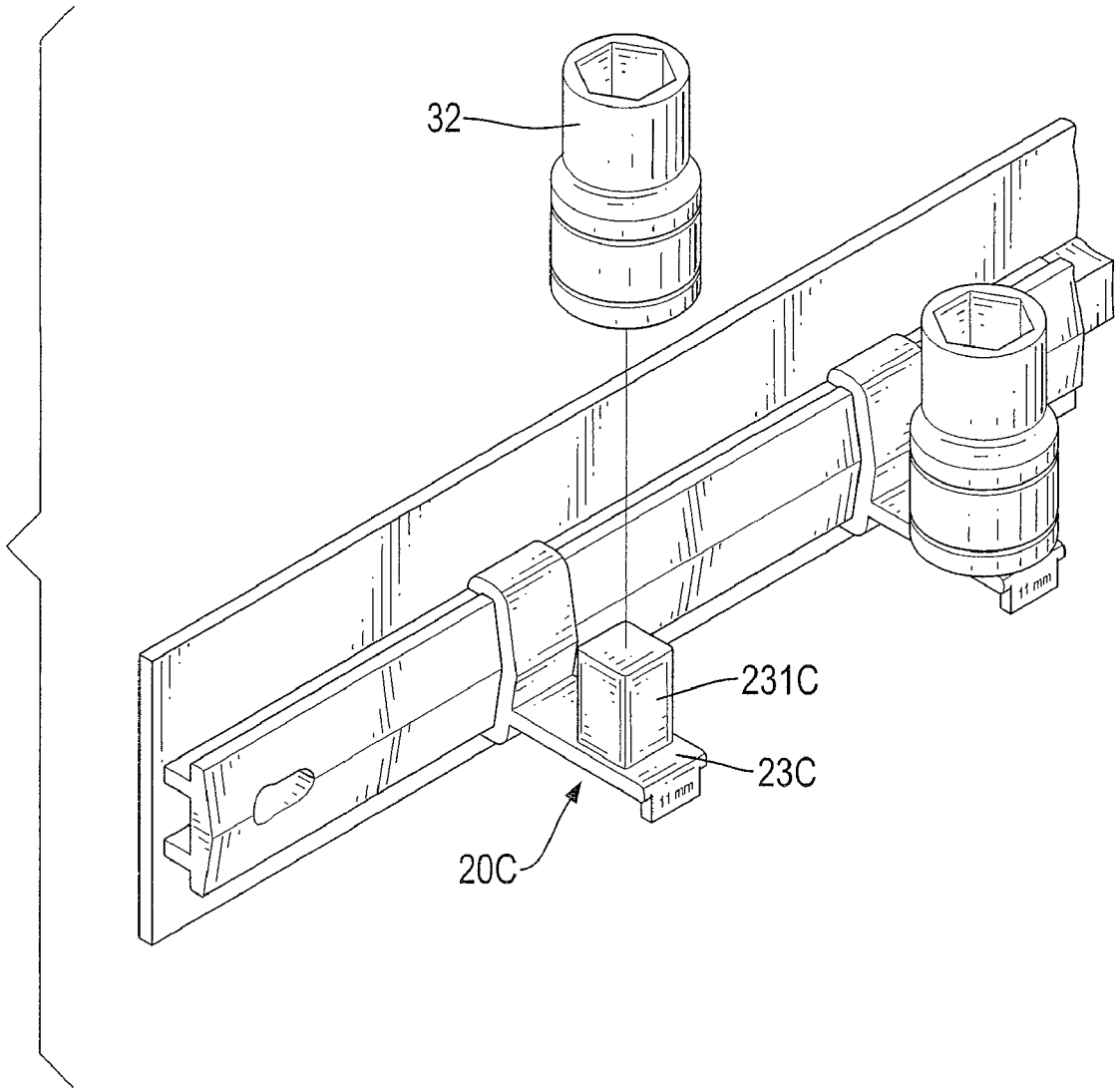
FIG. 9 is an operational exploded perspective view of the fourth preferred embodiment of the suspension display rack in FIG. 7 in usage.

With referenced to FIGS. 7 and 9, a fourth preferred embodiment of a suspension display rack in accordance with the present invention is similar to the first preferred embodiment except that each seat (23D) of the bracket (20D) is flat and has a post (231D). The post (231D) is formed uprightly on the seat (23D) and has a square cross section so that sockets can be mounted around the post (231D) for suspension.

Figure 10:
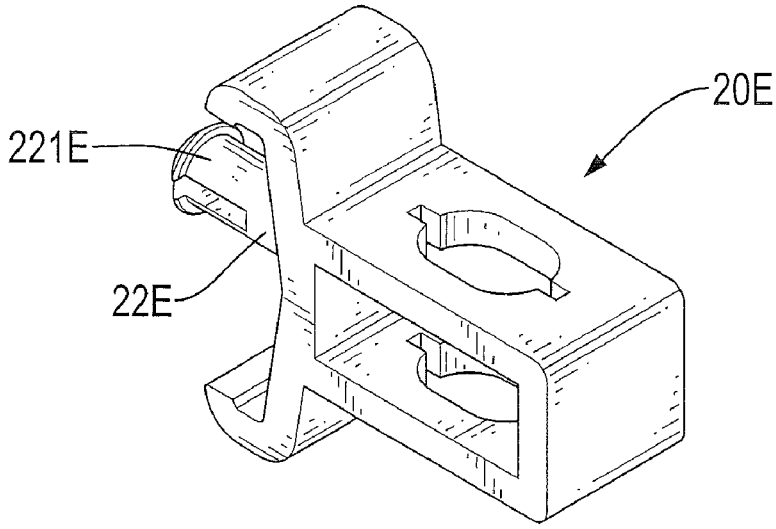
FIG. 10 is a perspective view of a fifth preferred embodiment of a bracket of a suspension display rack in accordance with the present invention.
Figure 12:
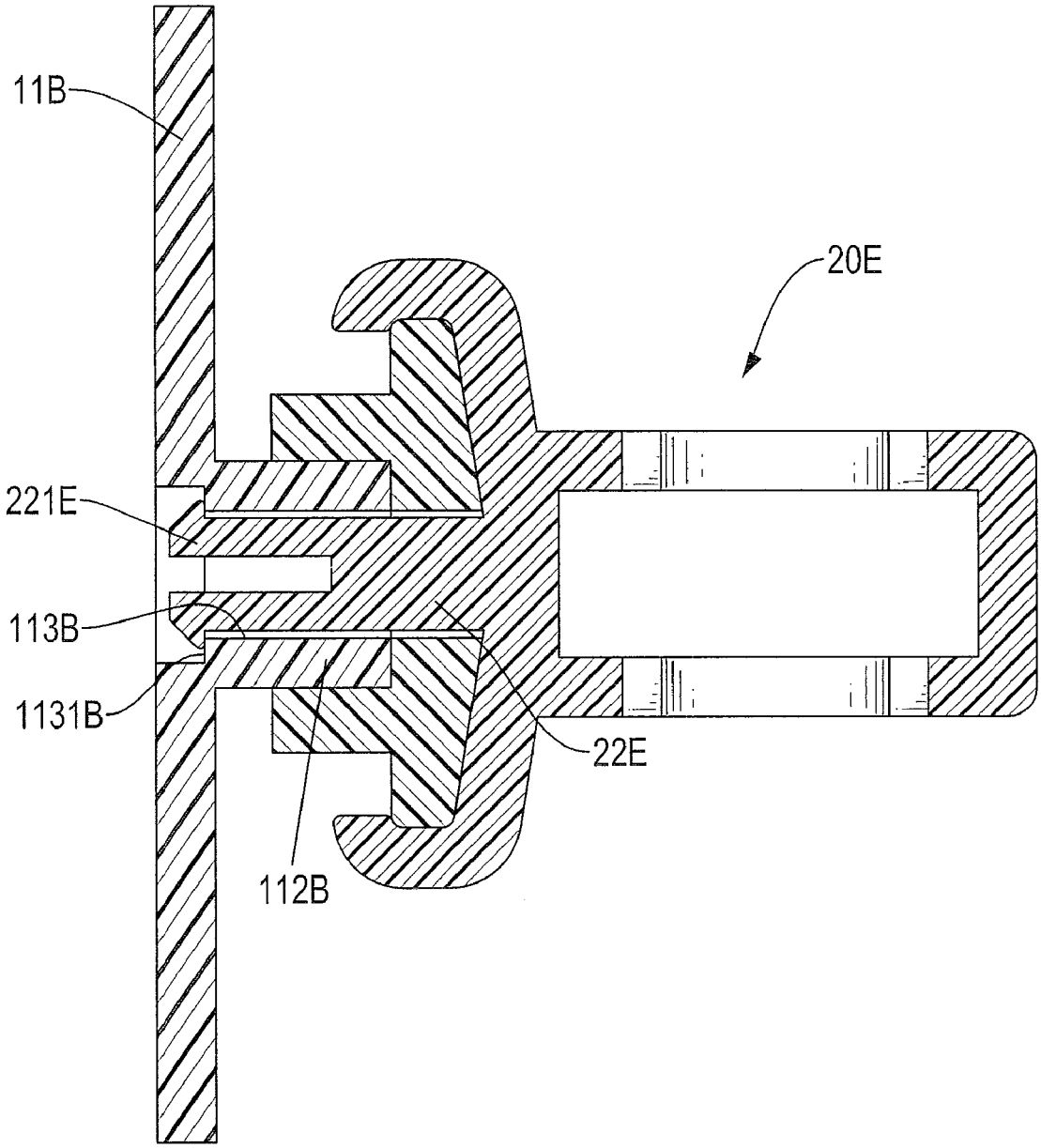
FIG. 12 is a cross sectional side view of the fifth preferred embodiment of the suspension display rack in FIG. 10.

With reference to FIGS. 10 and 12, a fifth preferred embodiment of a suspension display rack in accordance with the present invention is similar to the first preferred embodiment except that each jointing hole (113B) in the back strip (11B) has a shoulder (1131B) defined in the jointing hole (113B). Each bar (22E) of the bracket (20E) has a resilient grip (221E) formed in a free end of the bar (22E) so that the resilient grip (221E) can be engaged with the shoulder (1131B) to hold the bracket (20E) on the back strip (11B).

Figure 11:
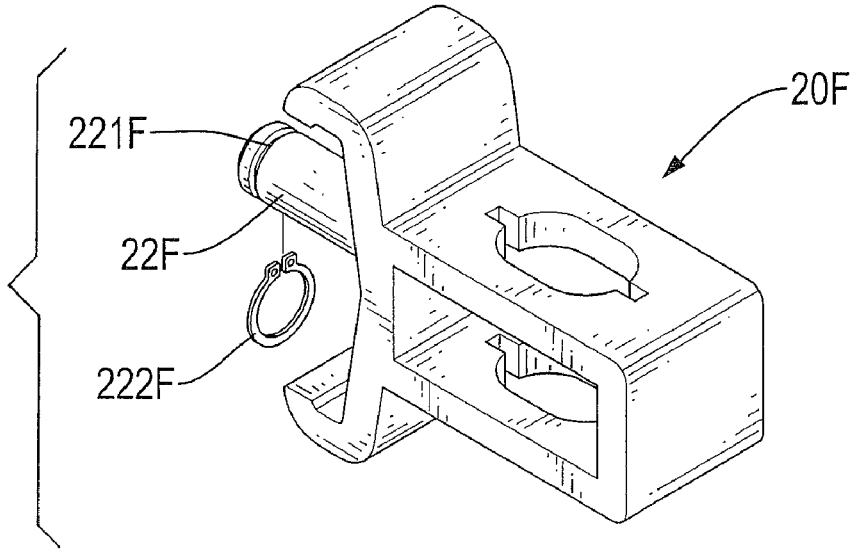
FIG. 11 is a perspective view of a sixth preferred embodiment of a bracket of a suspension display rack in accordance with the present invention.
Figure 13:
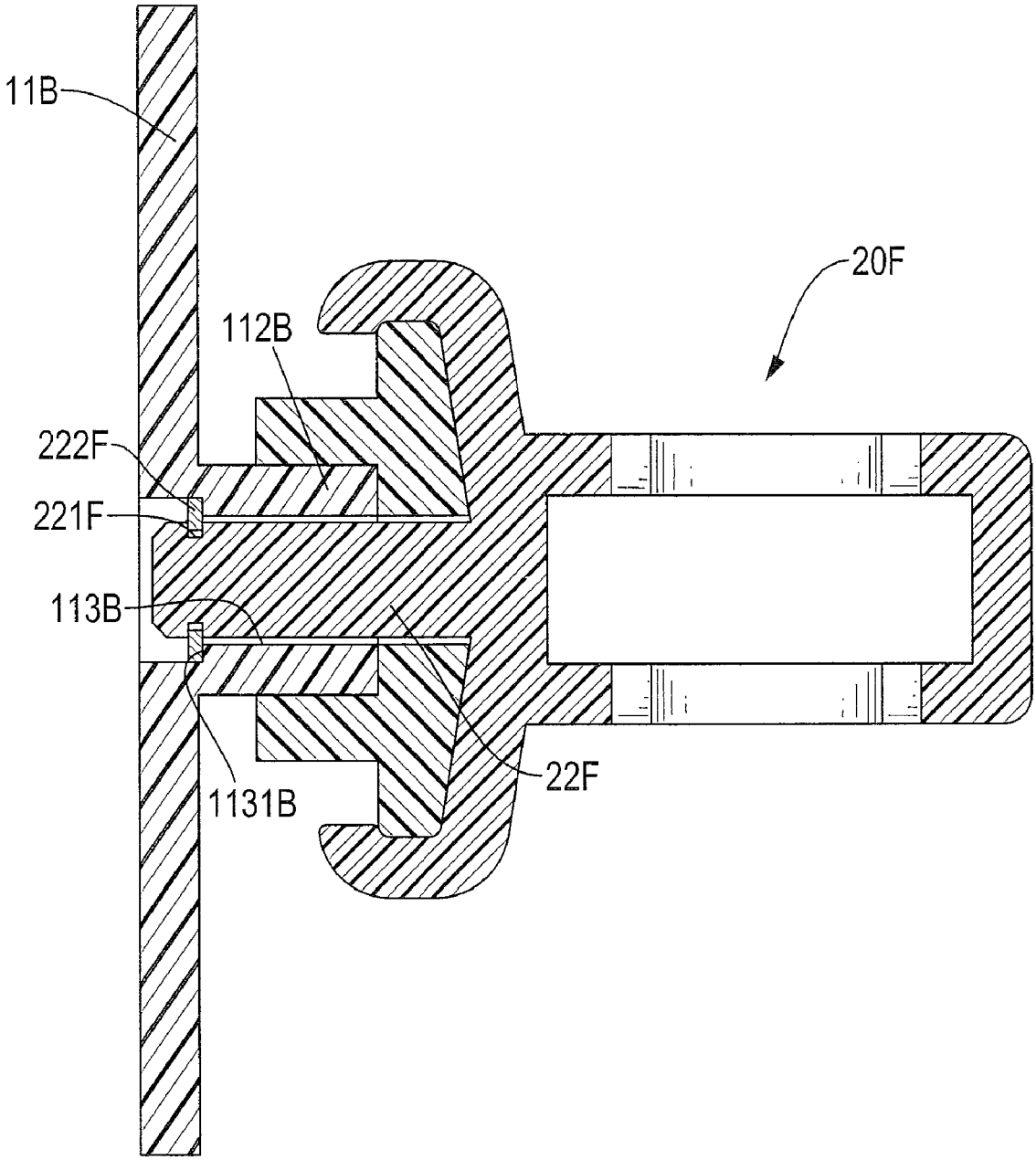
FIG. 13 is a cross sectional side view of the sixth preferred embodiment of the suspension display rack in FIG. 11.

With reference to FIGS. 11 and 13, a sixth preferred embodiment of a suspension display rack in accordance with the present invention is similar to the first preferred embodiment except that each jointing hole (113B) in the back strip (11B) has a shoulder (1131B) defined in the jointing hole (113B). Each bar (22F) of the bracket (20F) has an annular groove (221F) defined in a free end of the bar (22F). Multiple C-shaped rings (222F) respectively engage with the grooves (221F) and abut shoulders (1131B) in the jointing holes (113B) so that the bar (22F) can be coupled with the jointing hole (113B).

Figure 14:
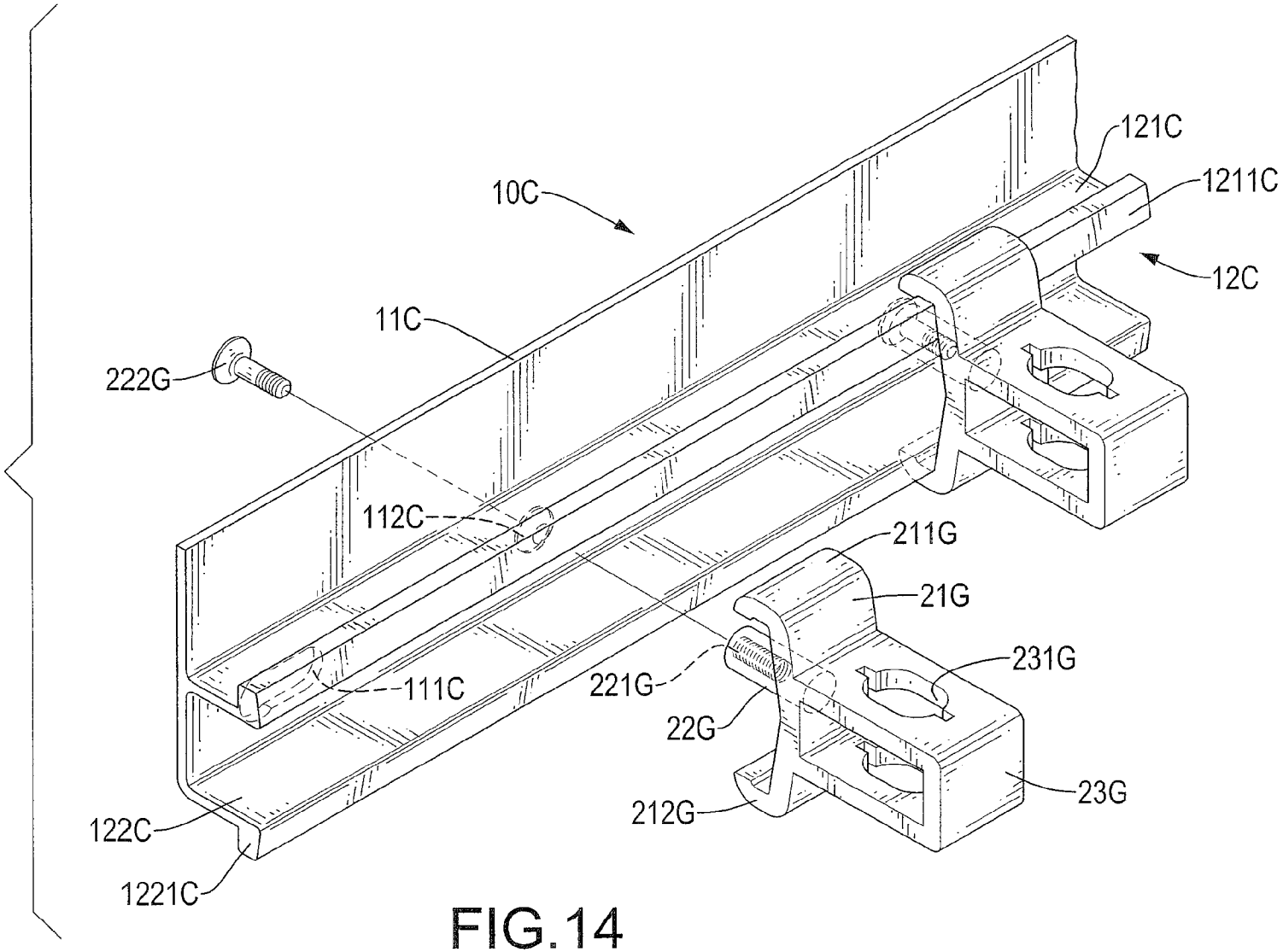
FIG. 14 is an exploded perspective view of a seventh preferred embodiment of a suspension display rack in accordance with the present invention.
Figure 15:
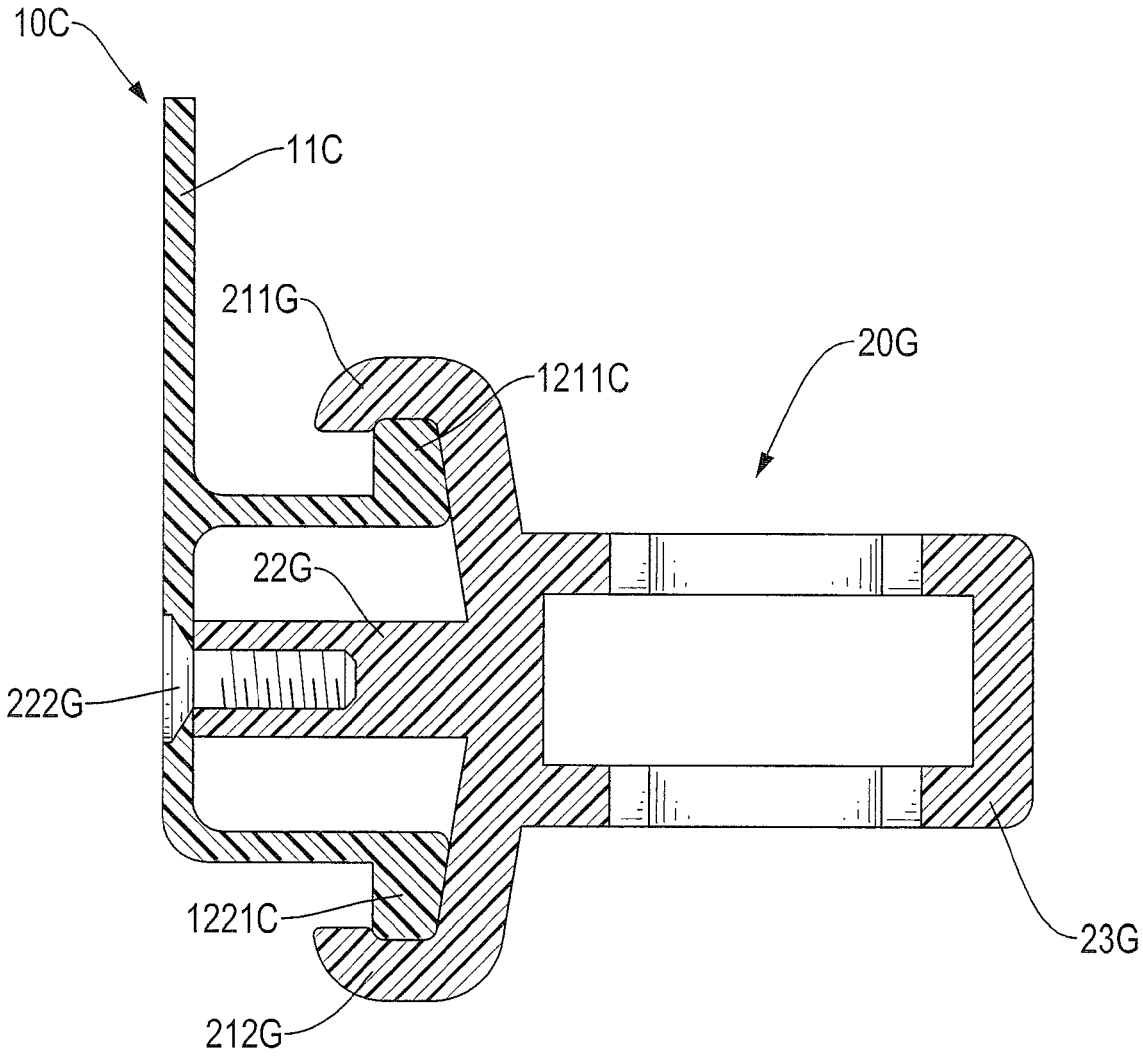
FIG. 15 is a side view in partial section of the seventh preferred embodiment of the suspension display rack in FIG. 14.

With reference to FIGS. 14 and 15, a seventh preferred embodiment of a suspension display rack in accordance with the present invention has a board (10C), and multiple brackets (20G) connecting to the board (10C).

The board (10C) is has a transverse back-strip (11C) and a rail (12C). The back strip (11C) has two first positioning holes (111C) and multiple jointing holes (112C). The first positioning holes (111C) are non-circular and are defined through the back strip (11C) and are respectively near two ends of the back strip (11C). The jointing holes (112C) are circular and are defined through the back strip (11C) and are between the positioning holes (111C).

The rail (12C) is formed on the back strip (11C) and has an upper plane (121C) and a lower plane (122C). The upper plane (121C) and the lower plane (122C) are formed separately on the back strip (11C). The positioning holes (111C) and the jointing holes (112C) in the back strip (11C) are defined between the upper plane (121C) and the lower plane (122C). An upper lug (1211C) is formed upward on a free end of the upper plane (121C) and a lower lug (1221C) is formed downward on a free end of the lower plane (122C).

Each bracket (20G) has a holder (21G), a bar (22G) and a seat (23G).

The holder (21G) is L-shaped and has an upper arm (211G) abutting the upper lug (1211C) and a lower arm (212G) abutting the lower lug (1221C) to hold the holder (21G) on the rail (12C).

The bar (22G) is circular in cross section, is formed transversely on a rear end of the holder (21G) and is inserted into the jointing holes (112C) of the back strip (11C). The bar (22G) has a threaded hole (221G) defined in a free end of the bar (22G). Multiple bolts (222G) respectively extend through the jointing holes (112C) in the back strip (11C) and are screwed respectively into the threaded holes (221G) of the bar (22G) thereby the bracket (20G) being coupled with the rail (12C).

The seat (23G) is formed on a front end of the holder (21G) and has a through hole (231G) defined longitudinally through the seat (23G).

In assembly, multiple bolts are screwed respectively into the positioning holes (111C) so that the board (10C) is securely mounted on a wall or a tool car and screwdrivers can be inserted into the through holes (231G) of the brackets (20G) for positioning.

Figure 16:
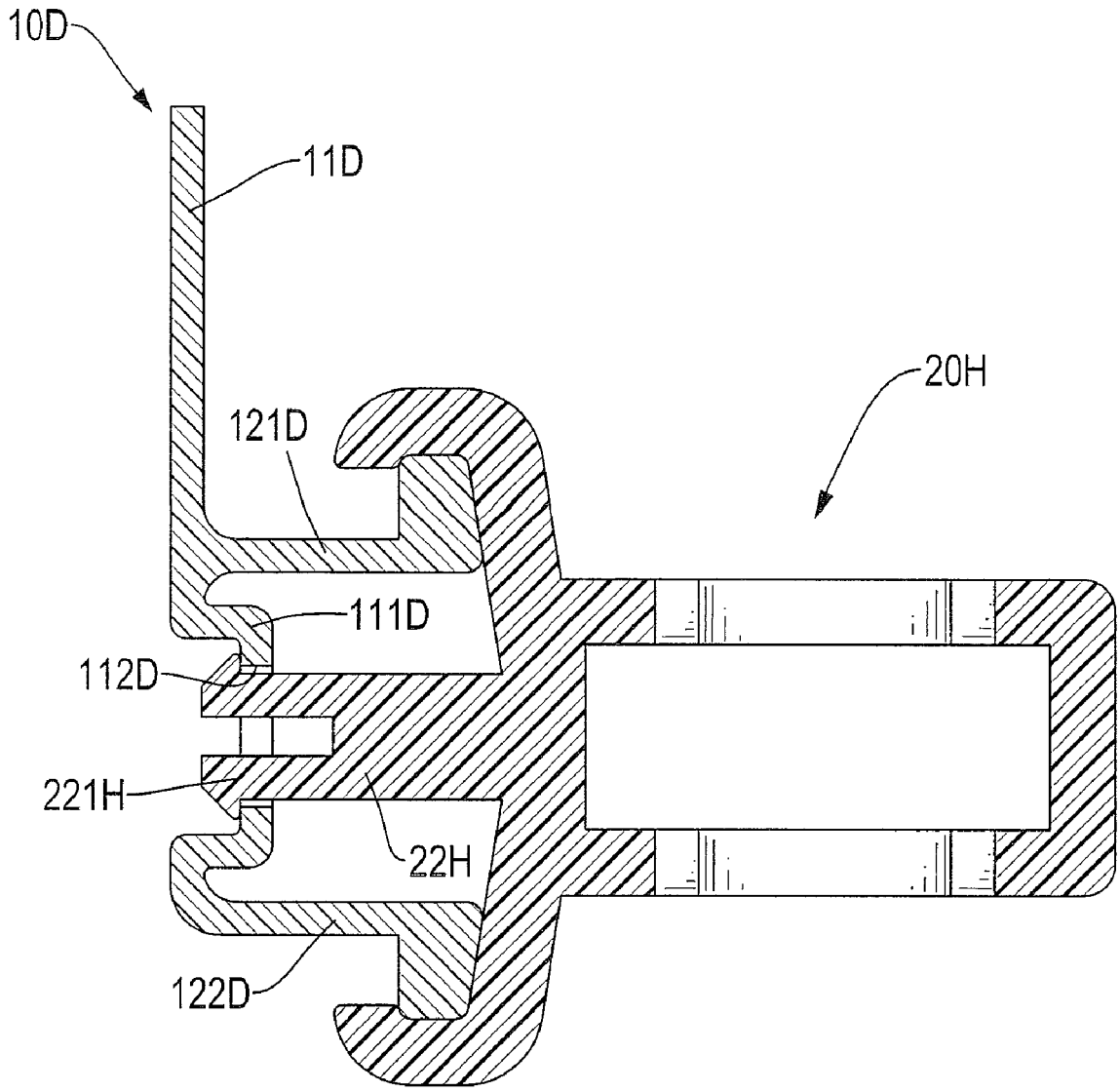
FIG. 16 is a cross sectional side view of an eighth preferred embodiment of a suspension display rack in accordance with the present invention.

With reference to FIG. 16, an eight preferred embodiment of a suspension display rack in accordance with the present invention is similar to the seventh preferred embodiment except that two reversed L-shaped portions (111D) are formed between the upper and lower plane (121D, 122D). An opening (112D) is defined between the reserved L-shaped portions (111D). Each bar (22H) has a hook (221H) formed in a free end of the bar (22H). The hooks (221H) of the bars (22H) abut the openings (112D) to hold the bracket (20H) on the back strip (11D).

Figure 17:
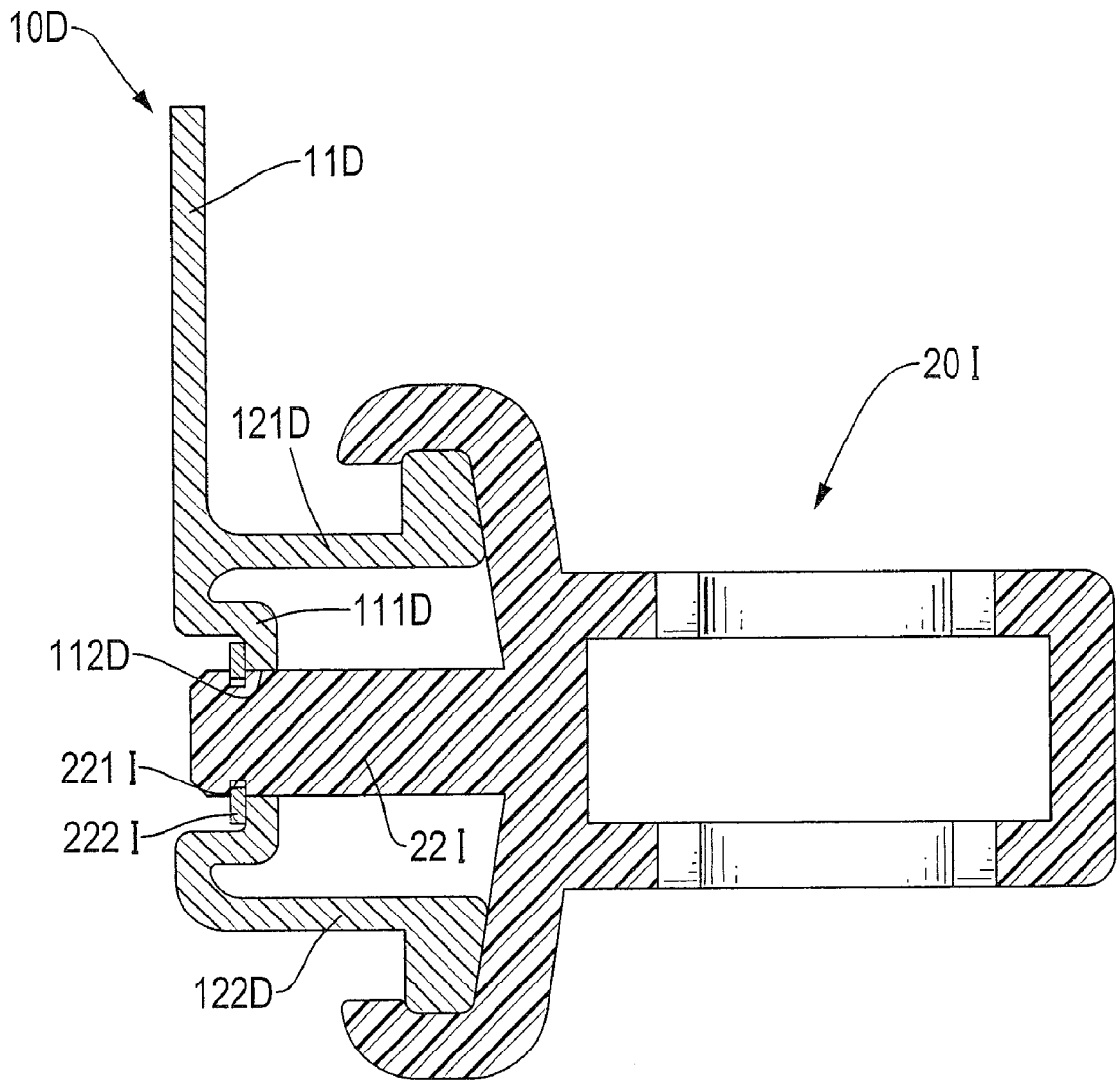
FIG. 17 is a cross sectional side view of a ninth preferred embodiment of a suspension display rack in accordance with the present invention.

With reference to FIG. 17, a ninth preferred embodiment of a suspension display rack in accordance with the present invention is similar to the seventh preferred embodiment except that two reversed L-shaped portions (111D) are formed between the upper and lower plane (121D, 122D). An opening (12D) is defined between the reserved L-shaped portions (111D). Each bar (22I) has a groove (221I) defined in a free end of the bar (22I). Multiple C-shaped rings (222I) engage with the grooves (221I) and abut the openings (112D) in the back strip (11D) to hold the bracket (20I) on the back strip (11D).

It is to be understood, however, that even though numerous characteristics and advantages of the present invention have been set forth in the foregoing description, together with details of the structure and function of the invention, the disclosure is illustrative only. Changes may be made in details, especially in matters of shape, size, and arrangement of parts within the principles of the invention to the full extent indicated by the broad general meaning of the terms in which the appended claims are expressed.

What is claimed is:

1. A suspension display rack comprising:

a board formed having a back strip having two non-circular first positioning holes formed through the back strip; and a rail mounted on a front surface of the back strip and having two sides;

an upper lug formed on one of the two sides of the rail; and a lower lug formed on the other one of the two sides of the rail; and multiple brackets mounted respectively on the rail and each bracket having a holder having an upper arm abutting the upper lug of the rail and a lower arm abutting the lower lug of the rail;

a bar being circular in cross section, formed transversely on a rear end of the holder and inserted into the rail; and a seat formed on a front end of the holder and having a supporting member, wherein the back strip has multiple jointing holes respectively defined through the back strip and corresponding respectively to the brackets; and the bars extend into the jointing holes in the back strip and each has a resilient grip formed in a free end of the bar and engaging a corresponding jointing hole, and wherein the rail has an upper plane and a lower plane formed separately on the back strip;

the first positioning holes and the jointing holes in the back strip are defined between the upper plane and the lower plane;

the upper lug is formed upward on a free end of the upper plane;

the lower lug is formed downward on a free end of the lower plane;

two reversed L-shaped portions are formed on the back strip and extend between the upper and the lower planes on which the arms of the holders of the brackets are mounted around; and the jointing holes are defined between the reserved L-shaped portions.

2. The suspension display rack as claimed in claim 1, wherein the supporting member of each seat is a through hole defined through two sides of the seat.

3. The suspension display rack as claimed in claim 1, wherein the supporting member of each seat is a recess defined in the seat.

4. The suspension display rack as claimed in claim 1, wherein the supporting member of each seat is a cylinder formed uprightly on the seat.

5. The suspension display rack as claimed in claim 1, wherein the supporting member of each seat is a post with a square cross section formed uprightly on the seat.

* * * * *